US011612864B2

(12) United States Patent
Yang et al.

(10) Patent No.: US 11,612,864 B2
(45) Date of Patent: Mar. 28, 2023

(54) APPARATUSES FOR MIXING GASES INTO LIQUIDS

(71) Applicants: Marmon Foodservice Technologies, Inc., Osseo, MN (US); Cornelius (Tianjin) Co., Ltd., Tianjin (CN)

(72) Inventors: Peiyuan Yang, Tianjin (CN); Tinghao Chen, Guangzhou (CN); Yulong Liu, Tianjin (CN); Hu Xu, Shanghai (CN); Wei Xing, Tianjin (CN); Weidong Song, Tianjin (CN)

(73) Assignees: Marmon Foodservice Technologies, Inc., Osseo, MN (US); Cornelius (Tianjin) Co., Ltd., Tianjin (CN)

( * ) Notice: Subject to any disclaimer, the term of this patent is extended or adjusted under 35 U.S.C. 154(b) by 669 days.

(21) Appl. No.: 16/319,697

(22) PCT Filed: Aug. 5, 2016

(86) PCT No.: PCT/CN2016/093555
§ 371 (c)(1),
(2) Date: Jan. 22, 2019

(87) PCT Pub. No.: WO2018/023713
PCT Pub. Date: Feb. 8, 2018

(65) Prior Publication Data

US 2021/0283558 A1 Sep. 16, 2021

(51) Int. Cl.
*B01F 3/04* (2006.01)
*B01F 23/236* (2022.01)
(Continued)

(52) U.S. Cl.
CPC ..... *B01F 23/2363* (2022.01); *B01F 25/23* (2022.01); *B01F 23/237621* (2022.01); *B01F 2101/14* (2022.01)

(58) Field of Classification Search
CPC ..... B01F 3/04815; B01F 5/0256; B01F 2003/049; B01F 2215/0022;
(Continued)

(56) References Cited

U.S. PATENT DOCUMENTS 998,428 A * 7/1911 Stuhler ..... B01F 3/04446 261/75
1,261,294 A * 4/1918 Ritchey ..... B01F 3/04808 426/477
(Continued)

FOREIGN PATENT DOCUMENTS

CN 203123868 U 8/2013
CN 103282304 9/2013
(Continued)

OTHER PUBLICATIONS

International Search Report, PCT/CN2016/093555, dated May 12, 2017.
(Continued)

*Primary Examiner* — Charles S Bushey
(74) *Attorney, Agent, or Firm* — Andrus Intellectual Property Law, LLP

(57) ABSTRACT

A beverage mixing assembly for mixing a gas into a liquid to thereby form a solution includes a mixer body having a first upstream inlet configured to receive the gas, a second upstream inlet configured to receive the liquid, and a downstream outlet configured to dispense the solution from the mixer body. The first upstream inlet defines a first orifice configured to spray the gas into the mixer body and the second upstream inlet defines a second orifice configured to spray the liquid into the mixer body such that the gas collides into the liquid as the liquid conveys from the second upstream inlet to the downstream outlet to thereby mix into the liquid and form the solution.

19 Claims, 4 Drawing Sheets

(51) Int. Cl.
*B01F 25/23* (2022.01)
*B01F 23/237* (2022.01)
*B01F 101/14* (2022.01)

(58) Field of Classification Search
CPC ..... B01F 2005/0034; B01F 2005/0054; B01F 23/2363; B01F 23/237621; B01F 25/23; B01F 2101/14
USPC ..... 261/78.2, 117, DIG. 7, 35
See application file for complete search history.

(56) References Cited

U.S. PATENT DOCUMENTS 1,592,305 A * 7/1926 Lewis ..... B01F 3/04787 261/43
1,836,329 A * 12/1931 Lombard ..... B01F 5/0077 261/75
3,617,032 A 11/1971 Tracy
3,618,905 A * 11/1971 Primus ..... B67D 1/04 261/50.1
3,761,066 A * 9/1973 Wheeler ..... B01F 5/0694 261/78.2
3,876,107 A * 4/1975 Meindl ..... B67D 1/0406 222/64
4,313,897 A * 2/1982 Garrard ..... B67D 1/0406 137/12.5
4,708,827 A 11/1987 McMillin
5,011,700 A * 4/1991 Gustafson ..... B67D 1/0462 261/DIG. 7
5,038,976 A 8/1991 McMillin
5,124,088 A 6/1992 Stumphauzer
5,419,461 A 5/1995 Goulet
5,515,687 A 5/1996 Arriulou
5,792,391 A 8/1998 Vogel et al.
8,567,767 B2 * 10/2013 Fantappie ..... B01F 5/0688 261/79.2
8,840,092 B2 9/2014 Kumar et al.
8,857,797 B2 10/2014 Kumar et al.
8,882,084 B2 11/2014 Malagi et al.
9,033,315 B2 * 5/2015 Phillips ..... B01F 3/04099 261/64.3
9,107,449 B2 8/2015 Njaastad et al.
9,114,368 B2 8/2015 Njaastad et al.
10,106,392 B2 * 10/2018 Peirsman ..... B67D 1/005
2004/0201114 A1 10/2004 Bellas et al.
2010/0163114 A1 * 7/2010 Yoshizawa ..... B01F 13/0059 137/87.01
2012/0038068 A1 2/2012 Bormes et al.

FOREIGN PATENT DOCUMENTS

CN 204485715 U 7/2015
CN 105498561 A 4/2016
EP 0873966 10/1998
EP 2070587 6/2009
WO 2015/119204 8/2015
WO 2015/124590 8/2015

OTHER PUBLICATIONS

Written Opinion, PCT/CN2016/093555, dated May 12, 2017.
Office Action for Chinese Patent Application No. Cn 201680088263.X, dated Feb. 20, 2021.

* cited by examiner

APPARATUSES FOR MIXING GASES INTO LIQUIDS

CROSS-REFERENCE TO RELATED APPLICATIONS

This application is the U.S. national stage application of International Application PCT/CN2016/093555, filed Aug. 5, 2016, which international application was published on Feb. 8, 2018 as International Publication WO 2018/023713 in the English language. The international application is incorporated herein by reference, in entirety.

FIELD

The present application relates to apparatuses for mixing gases into liquids, specifically mixer bodies having a pair of inlets which direct gases and liquids toward each other such that the gas collides into the liquid and mixes into a solution.

BACKGROUND

The following U.S. patents are incorporated herein by reference, in entirety:

U.S. Pat. No. 9,114,368 discloses a batch carbonation apparatus that includes a housing defining a vessel cavity. The housing includes an agitation mechanism. The pressure vessel includes a cap that has a CO2 inlet and a CO2 outlet. The pressure vessel also includes a seal. The pressure vessel is moveable into and out of the vessel cavity. A locking mechanism is provided and is attached to the agitation mechanism to removably lock the cap and seal relative to the pressure vessel. A CO2 source is connected to a plurality of valves where each valve has a differing pressure. A selection toggle is attached to the housing. A control mechanism is coupled to the plurality of valves. A user selects a desired carbonation level using the selection toggle and CO2 is introduced to the pressure vessel at a specified pressure wherein the agitation mechanism agitates liquid within the pressure vessel forming a carbonated beverage having a selected carbonation level. Also disclosed is a process of forming a carbonated beverage in a batch.

U.S. Pat. No. 9,107,449 discloses a CPU that controls an inlet valve, which connects a tank of pressurized carbon dioxide to a vessel containing the beverage to be carbonized. The tube connecting the tank of pressurized carbon dioxide to the vessel contains an orifice for reducing the carbon dioxide's flow rate, thereby increasing control over the amount of carbon dioxide introduced to the vessel. A motor agitates the vessel, causing the carbon dioxide to become absorbed in the beverage. During the pressurization process, the pressure inside the vessel is monitored by the CPU to determine whether more CO2 should be added to the vessel. An outlet valve causes excess pressure to drain from the vessel. An outlet orifice causes the pressure to release gradually, thus preventing the beverage from foaming.

U.S. Pat. No. 8,882,084 discloses an inline carbonation apparatus that includes a fluid tube having an inner diameter. At least one water orifice is linked to a water source and is attached at one end of the fluid tube. The water orifice atomizes water passing there through. A carbon dioxide source is connected to a carbon dioxide solenoid valve. The carbon dioxide solenoid valve is connected to a carbon dioxide regulator that is coupled to a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The carbon dioxide solenoid valve is opened and closed for a predetermined portion of a drink dispense time providing a volume of carbonated and non-carbonated fluid which upon mixing achieves a desired carbonation level.

U.S. Pat. No. 8,857,797 discloses an inline carbonation apparatus that includes a fluid tube having an inner diameter. At least one water orifice is linked to a water source and is attached to one end of the fluid tube. The water orifice includes a plurality of holes atomizing water that passes there through. A carbon dioxide orifice is linked to a carbon dioxide source and is attached to the fluid tube in a spaced relationship from the water orifice. The atomized water has a pressure less than the carbon dioxide such that carbon dioxide is absorbed into the water forming carbonated water having a specified volume of carbonation.

U.S. Pat. No. 8,840,092 discloses an inline carbonation apparatus that includes a fluid tube having an inner diameter. A water flow control module is connected to a water source. At least one water orifice is linked to the water flow control module and is attached at one end of the fluid tube. The water orifice includes a plurality of holes atomizing water passing there through. A carbon dioxide source is connected to a carbon dioxide valve. The carbon dioxide solenoid valve is connected to a carbon dioxide regulator that is coupled to a carbon dioxide orifice and attached to the fluid tube in a spaced relationship from the water orifice. The atomized water has a pressure less than the carbon dioxide such that carbon dioxide is absorbed into the water forming carbonated water having a specified volume of carbonation. The water control module regulates a water flow rate into the inline carbonation apparatus.

U.S. Pat. No. 5,792,391 discloses a carbonator comprising a tube cylinder having a closed and an open end. A disk is removably retained in the open end for providing access into the interior volume thereof. The disk provides for mounting thereto of water and carbon dioxide gas inlets, a carbonated water outlet, a safety relief valve and a water level sensor. A rigid retaining wire is bent into a square configuration wherein radiused corners thereof cooperate with slots in the open end of the cylinder to retain the disk therein. Manipulation of the retaining wire provides for removal of the disk from the cylinder when the carbonator is not pressurized.

U.S. Pat. No. 5,515,687 discloses an apparatus for providing carbonating of water. The apparatus includes a carbonating tank having a carbon dioxide inlet, a water inlet, and a carbonated water outlet. The carbonating tank is pivotally mounted to a rigid structure and connected to an electric motor for providing an undulating or rocking motion of the carbonator about its pivot mounting. The motion of the carbonating tank provides for carbonating of the water held therein.

U.S. Pat. No. 5,419,461 discloses a narrow profile substantially flat carbonator, consisting of a pair of cold drawn sheet metal halves. Each half defines corresponding alternating seams and ridges and are welded together around a perimeter thereof and along each corresponding seam. When both halves are welded together the ridges define an interior plurality of vertical interior columns, which columns are fluidly interconnected with top and bottom interior channels. The channel includes a pressure relief valve, a carbon dioxide inlet fitting, a water inlet fitting, and a level sensor fitting for retaining a level sensor. A plurality of carbonated water lines extend from the bottom of the carbonator and up along and closely adjacent a side of the carbonator. The carbonated water lines terminate at a point above the carbonator and provide for direct securing to a beverage dispensing valve. The carbonator is preferably of the integral type and held within the water tank of an ice bank type dispenser or within the ice bin of a cold plate cooled dispenser.

U.S. Pat. No. 5,038,976 discloses a beverage dispensing head and a method of dispensing that provides increased carbonation in a dispensed fountain beverage. The dispensing head has a discrete carbonated water decompression chamber in-between an upstream volumetric flow control and a downstream normally closed valve. The method includes the steps of propelling carbonated water through a flow control and then decompressing the carbonated water before it reaches the normally closed valve.

U.S. Pat. No. 4,708,827 discloses a method of and apparatus for making and dispensing carbonated water. A double diaphragm continuous delivery pneumatic liquid pump has a water pressure regulator on a water inlet line to the pump, a water fill line to a carbonator, a propellant exhaust line from the pump to the carbonator, a carbon dioxide line to the carbonator, and a gas pressure regulator for controlling the storage pressure in the carbonator and the exhaust back pressure in the pump propellant outlet. The exhaust back pressure is kept higher than the water pressure at the pump preventing diaphragm inversion.

U.S. Pat. No. 3,617,032 discloses a carbonator or carbonator-blender for producing and storing carbonated water or an admixture of carbonated water and syrup. An open-top bowl is disposed within a cylindrical carbon dioxide-pressurized chamber formed within a pressure tank. A nozzle is provided within the chamber for directing a conical stream of pressurized water into the bowl and another nozzle directs a stream of syrup against the side of the water stream. The bowl is provided with an abutment to produce a swirling action of the water and syrup there within and an aperture is formed in the bottom of the bowl for draining the admixture of water and syrup into the lower portion of the chamber.

SUMMARY

This Summary is provided to introduce a selection of concepts that are further described herein in the Detailed Description. This Summary is not intended to identify key or essential features from the claimed subject matter, nor is it intended to be used as an aid in limiting the scope of the claimed subject matter.

In certain examples, a beverage mixing assembly for mixing a gas into a liquid to thereby form a solution includes a mixer body having a first upstream inlet configured to receive the gas, a second upstream inlet configured to receive the liquid, and a downstream outlet configured to dispense the solution from the mixer body. The first upstream inlet defines a first orifice configured to spray the gas into the mixer body and the second upstream inlet defines a second orifice configured to spray the liquid into the mixer body such that the gas collides into the liquid as the liquid conveys from the second upstream inlet to the downstream outlet to thereby mix into the liquid and form the solution.

BRIEF DESCRIPTION OF THE DRAWINGS

Examples of the present disclosure are described with reference to the following drawing FIGURES. The same numbers are used throughout the FIGURES to reference like features and components.

DETAILED DESCRIPTION

In the present disclosure, certain terms have been used for brevity, clarity and understanding. No unnecessary limitations are to be inferred therefrom beyond the requirement of the prior art because such terms are used for descriptive purposes only and are intended to be broadly construed. The different apparatuses and methods described herein may be used alone or in combination with other apparatuses and methods. Various equivalents, alternatives and modifications are possible within the scope of the appended claims.

Through research and experimentation, the present inventors have endeavored to develop apparatuses, systems, and methods that effectively mix or inject gas into a liquid to thereby form a beverage. Accordingly, the present inventors have invented the presently disclosed machines that quickly and effectively mix or inject gas (e.g. nitrogen, CO2) in a liquid, such as coffee. The concentration of the gas in the solution can be efficiently adjusted to various levels based on the preferences of the operator and/or consumer.

Figure 1:
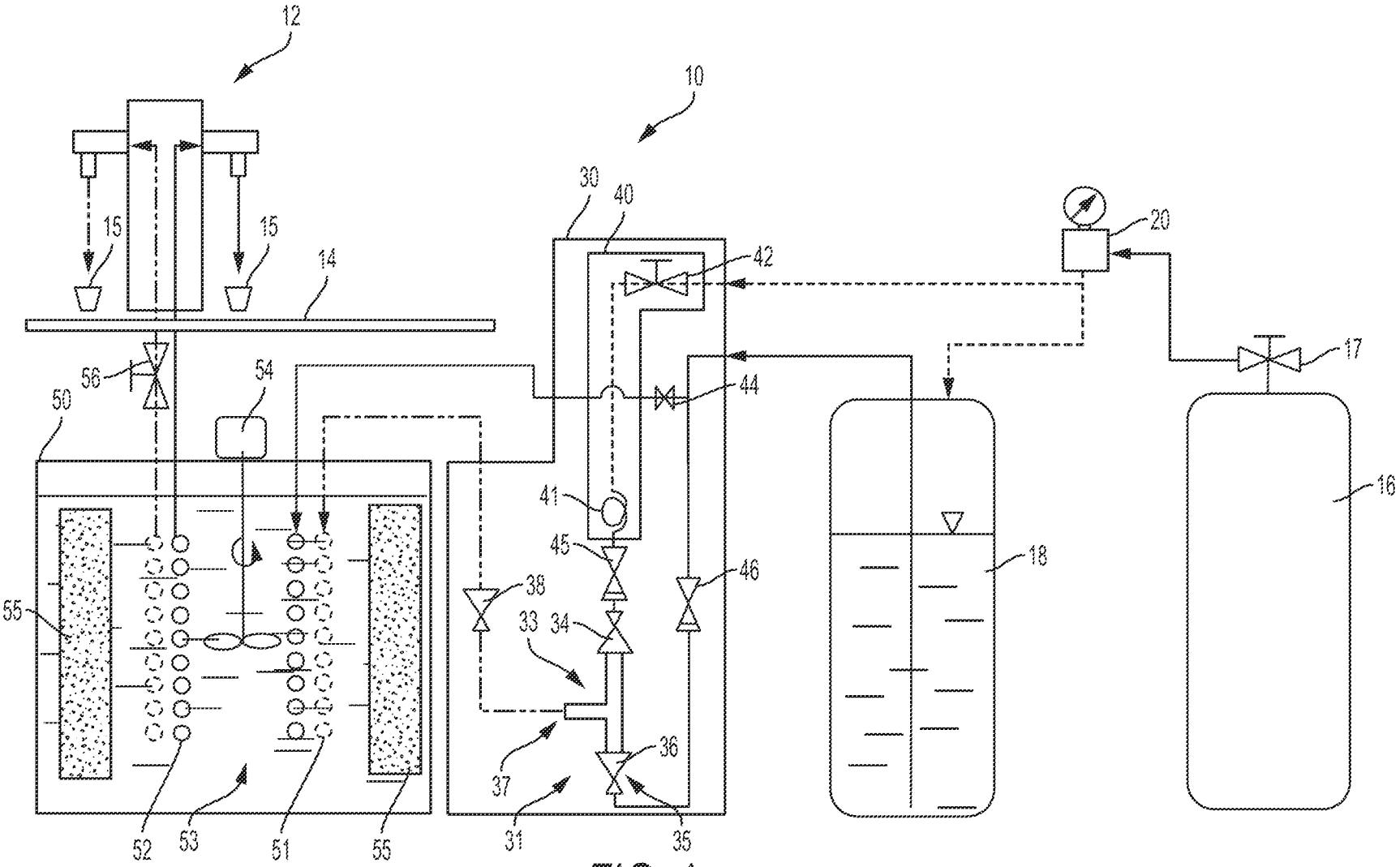
FIG. 1 is an example diagram of a gas mixing machine.

Referring to FIG. 1, an example gas mixing machine 10 includes a dispenser or conventional tap 12 for dispensing a solution (e.g. a liquid with a gas mixed therein) (see double-dot-dash line weight) and/or a liquid (e.g. coffee, juice) (see solid line weight). The solution and/or liquid is dispensed to an operator and/or a receptacle 15 (e.g. a cup) through the tap 12 which is mounted on the machine 10 and/or a countertop 14.

The machine 10 is coupled to a gas source 16 (e.g. gas tank) that is configured to supply gas (e.g. carbon dioxide, nitrogen) (see dashed line weight) to the machine 10 and/or a liquid source 18 (e.g. liquid tank, bag-in-box liquid container) that is configured to supply liquid (see solid line weight) to the machine 10. A gas valve 17 is coupled to the gas source 16 and is configured to selectively stop and start the flow of gas to the machine 10 (i.e. the operator can close the gas valve 17 when the gas source 16 is empty such that a new, full gas source 16 can be connected). The gas from the gas source 16 is used for mixing with the liquid in the beverage mixing assembly 30 to form the solution (to be described herein) and/or for pressurizing the liquid source 18. A gas regulator 20 is positioned downstream of the gas source 16 and regulates the flow of the gas to the beverage mixing assembly 30 and the liquid source 18. The pressure of the gas flowing between the gas regulator 20 and the beverage mixing assembly 30 is equivalent to the pressure of the gas flowing between the gas regulator 20 and the liquid source 18 such that the gas conveyed to the beverage mixing assembly 30 is at a pressure that is equal to a pressure of the liquid conveyed to the beverage mixing assembly 30. The gas pressurizes the liquid source 18 whereby the liquid flows to the beverage mixing assembly 30. In certain examples, the pressure of the gas conveyed to the beverage mixing assembly 30 and the pressure of the liquid conveyed to the beverage mixing assembly 30 are between 40.0 and 70.0 pounds per square inch (PSI).

Figure 2:
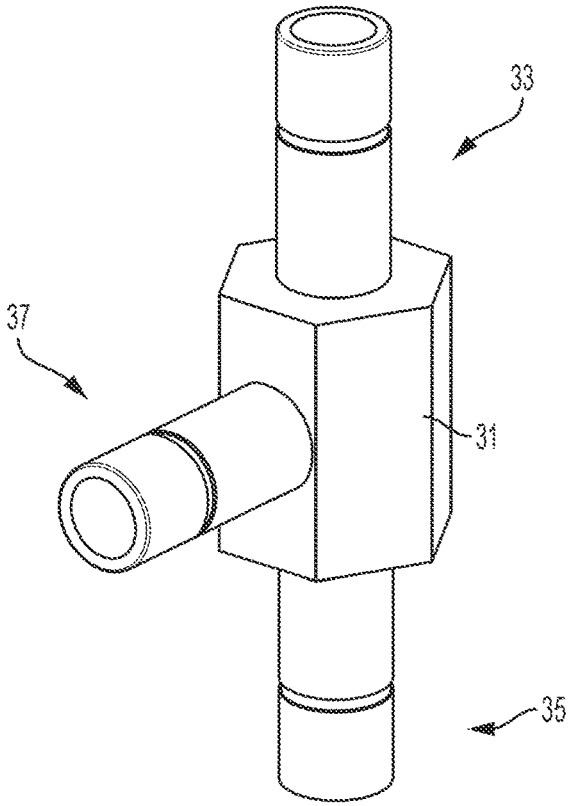
FIG. 2 is an example mixer body.
Figure 3:
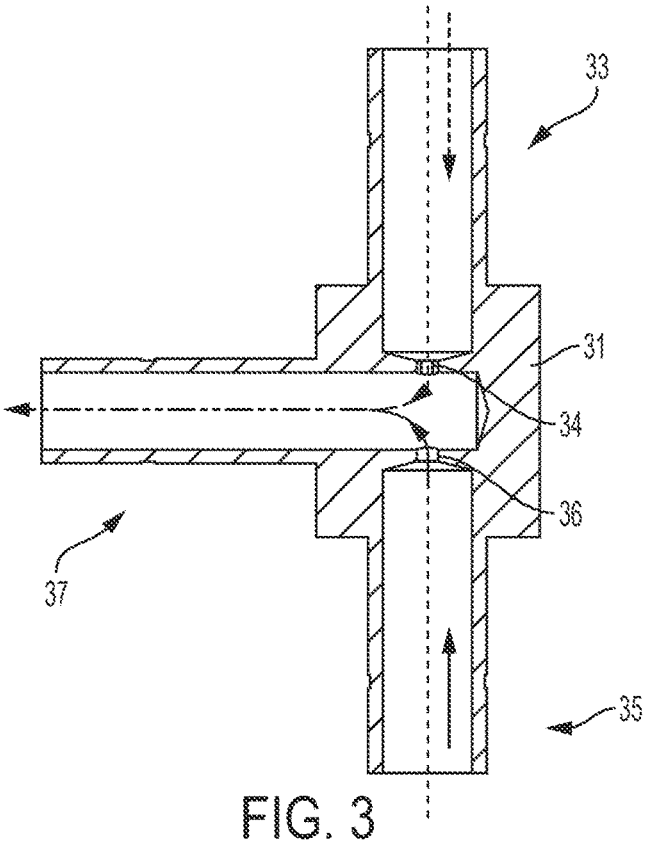
FIG. 3 is a cross sectional view of an example mixer body with example first and second orifices.

The beverage mixing assembly 30 includes a mixer body 31 having a first upstream inlet 33 configured to receive the gas from the gas source 16, a second upstream inlet 35 configured to receive the liquid from the liquid source 18, and a downstream outlet 37 configured to dispense the solution comprising the gas and the liquid from the mixer body 31 (see also FIGS. 2 and 3). The gas from the first upstream inlet 33 collides into the liquid from the second upstream inlet 35 as the liquid conveys from the second upstream inlet 35 to the downstream outlet 37 such that the gas mixes into the liquid to form the solution. The first upstream inlet 33 is axially opposite the second upstream inlet 35, and the downstream outlet 37 extends transversely to the first upstream inlet 33. In certain examples, the first upstream inlet 33 is coaxial with the second upstream inlet 35 (see dot line weight on FIG. 3). In certain examples, the first upstream inlet 33 is positioned vertically above the second upstream inlet 35 and such positioning can help drain by gravity any liquid trapped in the first upstream inlet 33. In certain examples, the downstream outlet 37 is perpendicular to the first upstream inlet 33 and the second upstream inlet 35. In the illustrated example, the mixer body 31 comprises a "T" pipe having an inner pipe diameter between 5.0 millimeters and 10.0 millimeters. The mixer body 31 can be any suitable shape such as straight, elbow, "L" shaped, and/or any other suitable shape. The configuration and/or shape of the mixer body 31 is merely exemplary and can vary from that which is shown.

Figure 4:
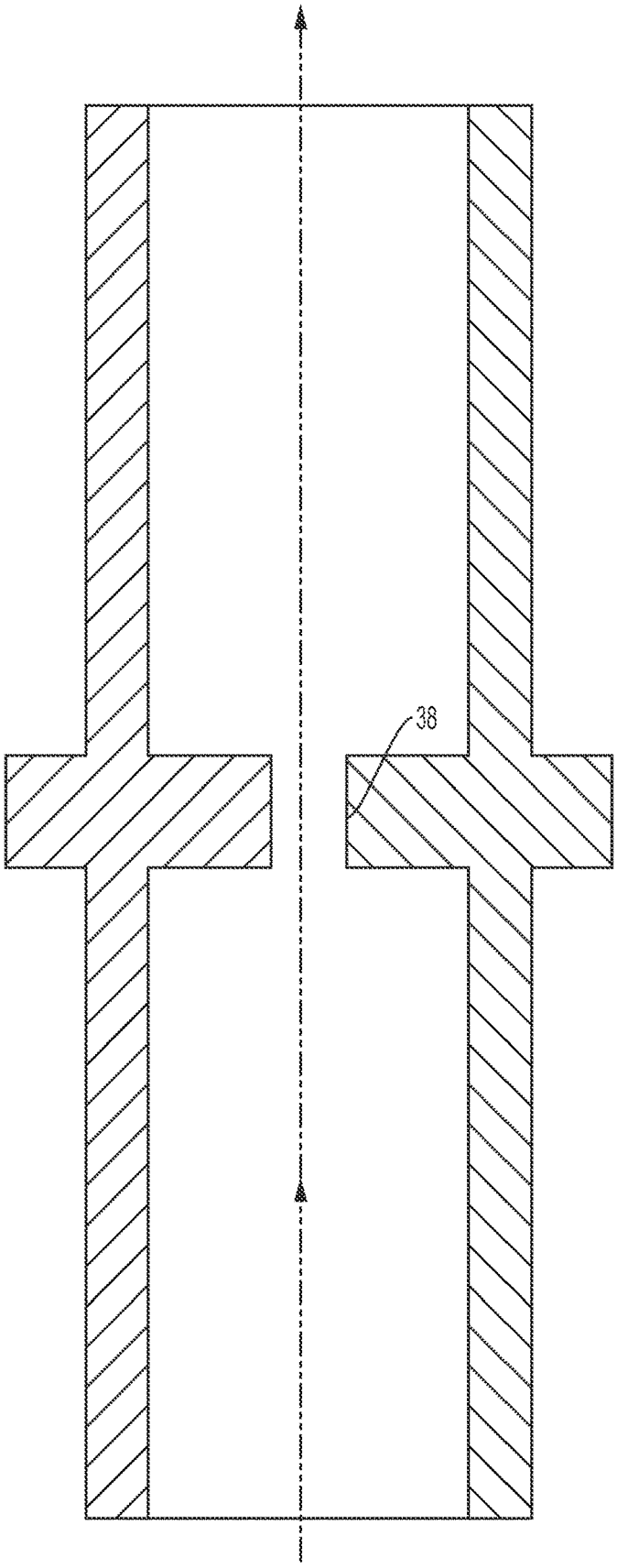
FIG. 4 is an example third orifice.
Figure 6:
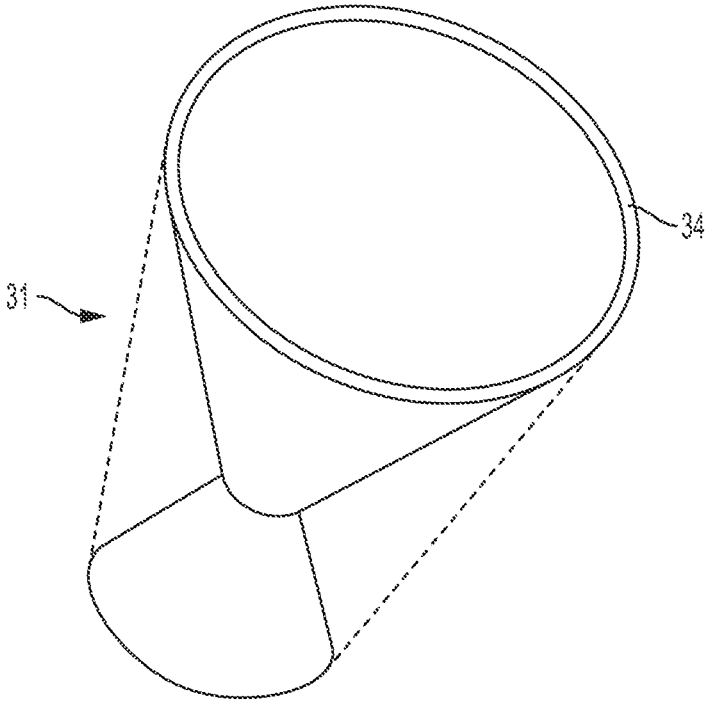
FIG. 6 is an example orifice.

The first upstream inlet 33 defines a first orifice 34 that is configured to spray the gas toward the liquid such that the gas collides and mixes with the liquid to form the solution, and the second upstream inlet 35 defines a second orifice 36 that is configured to spray the liquid toward the gas such that the liquid collides and mixes with the gas to form the solution (see also FIG. 6 which depicts an example first orifice 34). The pressure of the liquid downstream of the second orifice 36 is equal to the pressure of the gas downstream of the first orifice 34. In certain examples, the pressure of the liquid downstream of the second orifice 36 is less than the pressure of the gas downstream of the first orifice 34. The diameter of the first orifice 34 is between 0.5 millimeters and 1.5 millimeters, and the diameter of the second orifice 36 is between 1.5 millimeters and 3.0 millimeters. The orifices 34, 36 enhance turbulent convection of the gas and the liquid in the mixer body thereby enhancing the mixing of the gas and the liquid into the solution. In certain examples, the pressure drop across the orifices 34, 36, independently or in combination, is between 5.0 and 20.0 PSI. In certain examples, a third orifice 38 is included with the downstream outlet 37 or downstream of the downstream outlet 37 such that the third orifice 38 further mixes the gas and the liquid (see FIG. 4). The diameter of the third orifice 38 is between 2.0 millimeters and 4.0 millimeters.

Figure 5:
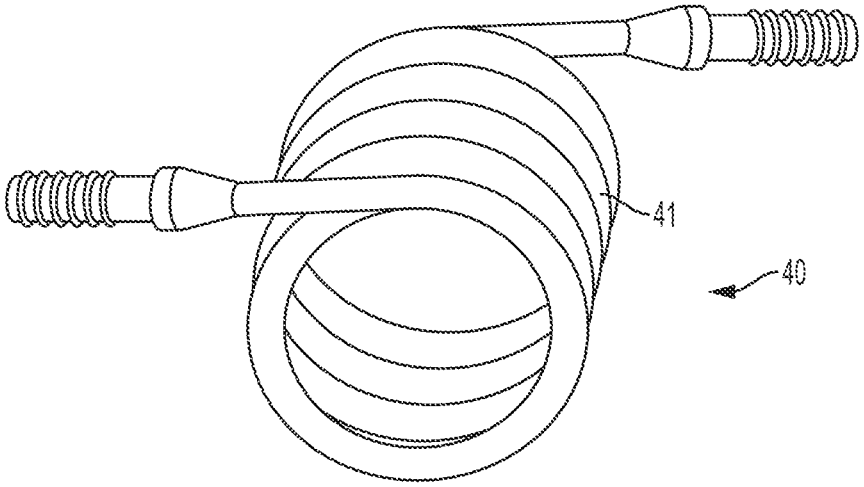
FIG. 5 is an example capillary tube.

The beverage mixing assembly 30 includes a pressure drop device 40 positioned upstream of the first upstream inlet 33 and configured to reduce the pressure of the gas received by the first upstream inlet 33. The pressure drop device 40 comprises a capillary tube 41 (see also FIG. 5), a gas regulator 42, or the capillary tube 41 and the gas regulator 42 in combination. The pressure drop device 40 can include any number of components (e.g. capillary tube 41, second gas regulator 42) that are configured to reduce the pressure of the gas. In certain examples, the pressure drop of the gas between the gas source 16 and the first upstream inlet 33 is equal to the pressure drop of the liquid between the liquid source 18 and the second upstream inlet.

The beverage mixing assembly 30 includes a valve 44 that selectively opens and closes to convey the liquid from the liquid source 18 directly to a chiller 50 (discussed herein) and the tap 12 (i.e. the liquid bypasses the mixer body 31 and does not mix with the gas).

The beverage mixing assembly 30 includes a first check valve 45 positioned upstream of the first upstream inlet 33 and downstream of the pressure drop device 40. The first check valve 45 prevents liquid sprayed by the second orifice 36 from entering the pressure drop device 40. The beverage mixing assembly 30 includes a second check valve 46 positioned upstream of the second upstream inlet 35 and downstream of the liquid source 18. The second check valve 46 prevents gas sprayed by the first orifice 34 from entering the liquid source 18.

The machine 10 can include the chiller 50, which is configured to cool the solution downstream of the beverage mixing assembly 30. The chiller 50 includes a first cooling coil 51 configured to receive the solution from the beverage mixing assembly 30 and a second cooling coil 52 configured to receive the liquid with out the gas mixed therein (note that FIG. 1 depicts the cooling coils 51, 52 in cross section). The chiller 50 receives a heat transfer media 53 that is configured to transfer heat with the cooling coils 51, 52. The heat transfer media 53 can be heated or cooled by a refrigeration system (not shown). In certain examples, the heat transfer media 53 includes icebanks 55. The chiller 50 can include an agitator 54 configured to agitate the heat transfer media 53 such that the heat transfer media 53 effectively and efficiently transfers heat with the cooling coils 51, 52. The chiller 50 can include a shutoff valve 56 that allows a user or operator to adjust the flow rate of the solution and/or liquid to the tap 12. In certain examples, the chiller 50 and/or the first cooling coil 51 provides a longer period of time and additional volume for the gas to mix into the solution.

In certain examples, a beverage mixing assembly for mixing a gas into a liquid to thereby form a solution includes a mixer body having a first upstream inlet configured to receive the gas, a second upstream inlet configured to receive the liquid, and a downstream outlet configured to dispense the solution from the mixer body. The first upstream inlet defines a first orifice configured to spray the gas into the mixer body and the second upstream inlet defines a second orifice configured to spray the liquid into the mixer body such that the gas collides into the liquid as the liquid conveys from the second upstream inlet to the downstream outlet to thereby mix into the liquid and form the solution. In the certain examples, the first upstream inlet and the second upstream inlet are axially opposite with respect to each other and/or the downstream outlet extends transversely to the first upstream inlet. In certain examples, the pressure of the liquid downstream of the second orifice is equal to the pressure of the gas downstream of the first orifice. In certain examples, the pressure drop device positioned upstream of the first upstream inlet is configured to reduce the pressure of the gas received by the first upstream inlet. The pressure drop device can include a capillary tube. In certain examples, a check valve is positioned upstream of the first upstream inlet and downstream of the capillary tube such that the check valve prevents liquid sprayed by the second orifice from entering the capillary tube.

In certain examples, the beverage mixing assembly for mixing a gas from a gas supply into a liquid from a liquid supply to form a solution includes a mixer body having a first upstream inlet configured to receive the gas from the gas supply and defining a first orifice configured to spray the gas; a second upstream inlet configured to receive the liquid from the liquid supply and defining a second orifice configured to spray the liquid; and a downstream outlet configured to dispense the solution. The beverage mixing assembly is configured such that the gas supply has a pressure that is equal to a pressure of the liquid supply. In certain examples, the pressure drop of the gas between the gas supply and the first upstream inlet is equal to the pressure drop of the liquid between the liquid supply and the second upstream inlet.

In certain examples, the pressure drop of the gas and/or the liquid in and/or leading to the mixer body determines a stable ratio between the gas and the liquid. The flow of the gas, liquid, and/or the solution can conform to $$m_{gas} = A_2 * \sqrt{\frac{2k}{k-1}(p_1\rho_1)\left[\left(\frac{p_2}{p_1}\right)^{2/k} - \left(\frac{p_2}{p_1}\right)^{(k+1)/k}\right]}$$

and/or $$Q_{liquid} = C_d * A * \sqrt{2 * \frac{p1 - p2}{\rho}}.$$

The orifices can create a pressure drop in the gas and liquid, respectively, that can be used to determine the stable ratio between the gas and the liquid. Further, the upstream pressure drop and/or flow rate of the gas and/or liquid can change at the same time. The ratio of gas and liquid can be controlled to prevent large pressure variations in the beverage mixing assembly.

This written description uses examples to disclose the invention, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A beverage mixing assembly for mixing a gas into a liquid to thereby form a solution, the beverage mixing assembly comprising:

a mixer body comprising:

a first upstream inlet configured to receive the gas, the first upstream inlet defining a first orifice configured to spray the gas into the mixer body;

a second upstream inlet configured to receive the liquid, the second upstream inlet defining a second orifice configured to spray the liquid into the mixer body; and a downstream outlet configured to dispense the solution from the mixer body;

a pressure drop device positioned upstream of the first upstream inlet and configured to reduce the pressure of the gas received by the first upstream inlet; and a check valve positioned upstream of the first upstream inlet and downstream of the pressure drop device, wherein the check valve prevents liquid sprayed by the second orifice from entering the pressure drop device;

wherein the gas collides into the liquid as the liquid conveys from the second upstream inlet to the downstream outlet to thereby mix into the liquid and form the solution.

2. The beverage mixing assembly according to claim 1, wherein the first upstream inlet is axially opposite the second upstream inlet and the downstream outlet extends transversely to the first upstream inlet.

3. The beverage mixing assembly according to claim 1, wherein the mixer body is configured so that a pressure of the liquid downstream of the second orifice is equal to a pressure of the gas downstream of the first orifice.

4. The beverage mixing assembly according to claim 3, wherein a diameter of the first orifice is between 0.5 millimeters and 1.5 millimeters, and wherein a diameter of the second orifice is between 1.5 millimeters and 3.0 millimeters.

5. The beverage mixing assembly according to claim 4, wherein the mixer body comprises a "T"-pipe having an inner pipe diameter between 5.0 millimeters and 10.0 millimeters.

6. The beverage mixing assembly according to claim 5, wherein the mixer body comprises a third orifice at the downstream outlet, the third orifice having a diameter between 2.0 millimeters and 4.0 millimeters, and wherein a flow path from the first and second orifices to the third orifice is unobstructed.

7. The beverage mixing assembly according to claim 1, further comprising a chiller positioned downstream of the mixer body and configured to cool the solution.

8. The beverage mixing assembly according to claim 1, further comprising:

a gas supply configured to provide the gas to the first upstream inlet; and a liquid supply configured to provide the liquid to the second upstream inlet;

wherein the gas is connected to the liquid supply to pressurize the liquid in the liquid supply with the gas from the gas supply.

9. The beverage mixing assembly of claim 8, wherein the pressure drop device comprises a flow rate regulator positioned between the gas supply and the first orifice and positioned between the gas supply and the liquid supply.

10. A beverage mixing assembly for mixing a gas into a liquid to thereby form a solution, the beverage mixing assembly comprising:

a mixer body comprising:

a first upstream inlet configured to receive the gas, the first upstream inlet defining a first orifice configured to spray the gas into the mixer body;

a second upstream inlet configured to receive the liquid, the second upstream inlet defining a second orifice configured to spray the liquid into the mixer body; and a downstream outlet configured to dispense the solution from the mixer body;

a capillary tube positioned upstream of the first upstream inlet and configured to reduce the pressure of the gas received by the first upstream inlet; and a check valve positioned upstream of the first upstream inlet and downstream of the capillary tube, wherein the check valve prevents liquid sprayed by the second orifice from entering the capillary tube;

wherein the gas collides into the liquid as the liquid conveys from the second upstream inlet to the downstream outlet to thereby mix into the liquid and form the solution.

11. The beverage mixing assembly of claim 10, further comprising:

a gas supply configured to provide the gas to the first upstream inlet; and a liquid supply configured to provide the liquid to the second upstream inlet;

wherein the gas is connected to the liquid supply to pressurize the liquid in the liquid supply with the gas from the gas supply.

12. The beverage mixing assembly of claim 11, further comprising a flow rate regulator positioned between the gas supply and the liquid supply.

13. The beverage mixing assembly of claim 10, further comprising a chiller positioned downstream of the mixer body and configured to cool the solution.

14. A beverage mixing assembly for mixing a gas into a liquid to thereby form a solution, the beverage mixing assembly comprising:

a mixer body including a "T"-pipe having an inner pipe diameter between 5.0 millimeters and 10.0 millimeters, the mixer body further comprising:

a first upstream inlet configured to receive the gas, the first upstream inlet defining a first orifice configured to spray the gas into the mixer body, wherein a diameter of the first orifice is between 0.5 millimeters and 1.5 millimeters;

a second upstream inlet configured to receive the liquid, the second upstream inlet defining a second orifice configured to spray the liquid into the mixer body, wherein a diameter of the second orifice is between 1.5 millimeters and 3.0 millimeters; and a downstream outlet configured to dispense the solution from the mixer body, the downstream outlet comprising a third orifice having a diameter between 2.0 millimeters and 4.0 millimeters;

wherein the gas collides into the liquid as the liquid conveys from the second upstream inlet to the downstream outlet to thereby mix into the liquid and form the solution;

wherein the mixer body is configured so that a pressure of the liquid downstream of the second orifice is equal to a pressure of the gas downstream of the first orifice; and wherein the flow path from the first and second orifices to the third orifice is unobstructed.

15. The beverage mixing assembly of claim 14, wherein the first upstream inlet is axially opposite the second upstream inlet and the downstream outlet extends transversely to the first upstream inlet.

16. The beverage mixing assembly according to claim 14, further comprising a pressure drop device positioned upstream of the first upstream inlet and configured to reduce the pressure of the gas received by the first upstream inlet.

17. The beverage mixing assembly according to claim 14, further comprising:

a gas supply configured to provide the gas to the first upstream inlet; and a liquid supply configured to provide the liquid to the second upstream inlet;

wherein the gas is connected to the liquid supply to pressurize the liquid in the liquid supply with the gas from the gas supply.

18. The beverage mixing assembly of claim 17, wherein the pressure drop device comprises a flow rate regulator positioned between the gas supply and the first orifice and positioned between the gas supply and the liquid supply.

19. The beverage mixing assembly according to claim 14, further comprising a chiller positioned downstream of the mixer body and configured to cool the solution.

* * * * *